US006053104A

United States Patent [19]

Marks

[11] Patent Number: 6,053,104

[45] Date of Patent: Apr. 25, 2000

[54] PRINTING DEVICE WITH A DEVICE FOR CLEANING THE PRINTING SUBSTRATES SUPPLIED TO THE PRINTING MACHINE

[75] Inventor: Michael Marks, Mülheim/Ruhr, Germany

[73] Assignee: Ernst Marks GmbH & Co. KG, Germany

[21] Appl. No.: 09/123,906

[22] Filed: Jul. 27, 1998

[30] Foreign Application Priority Data

Jul. 26, 1997 [DE] Germany ..... 197 32 235

[51] Int. Cl.[7] ..... B41F 35/00

[52] U.S. Cl. ..... 101/425; 101/423

[58] Field of Search ..... 101/425, 424, 101/423; 15/256.52, 256.51, 256.5

[56] References Cited

U.S. PATENT DOCUMENTS

| | | | |
|---|---|---|---|
| 1,703,015 | 2/1929 | Ratignier | 101/425 |
| 3,932,910 | 1/1976 | Shimoda | 15/256 |
| 5,202,534 | 4/1993 | Tamiya et al. | 118/660 |
| 5,603,775 | 2/1997 | Sjoberg | 134/21 |
| 5,644,986 | 7/1997 | Gydesen | 101/425 |
| 5,657,693 | 8/1997 | Kumaki et al. | 101/423 |
| 5,740,739 | 4/1998 | Herold et al. | 101/425 |
| 5,768,993 | 6/1998 | Stuart | 101/425 |

FOREIGN PATENT DOCUMENTS

| | | |
|---|---|---|
| 2006716 | 9/1970 | Germany . |
| 490967 | 10/1969 | Switzerland . |

*Primary Examiner*—John S. Hilten
*Assistant Examiner*—Anthony H. Nguyen
*Attorney, Agent, or Firm*—Robert W. Becker & Associates

[57] ABSTRACT

A printing machine has a printing cylinder receiving printing substrates for printing. A cleaning device for cleaning the printing substrates transferred to the printing cylinder is provided. The cleaning device has a slotted nozzle connected to a vacuum source and having a slot opening. The cleaning device includes a compressed air conduit extending perpendicularly to the direction of movement of the printing substrates. The compressed air conduit is arranged centrally in the slot opening and extends in the longitudinal direction of the slot opening such that on opposite sides of the compressed air conduit two slots are formed in the longitudinal direction. The compressed air conduit has compressed air outlets directing the air flow onto the printing substrates. The compressed air outlets have a diameter of 2 mm to 4 mm and the air nozzle has a width of 15 mm to 25 mm.

6 Claims, 2 Drawing Sheets

PRINTING DEVICE WITH A DEVICE FOR CLEANING THE PRINTING SUBSTRATES SUPPLIED TO THE PRINTING MACHINE

BACKGROUND OF THE INVENTION

The present invention relates to a printing machine which is provided with a cleaning device for cleaning the especially sheet-like or continuous-feed printing substrates supplied to the printing machine, whereby the cleaning device comprises a compressed air conduit extending perpendicularly to the direction of transport of the printing substrates and having compressed air outlets oriented toward the printing substrate. The compressed air conduit is essentially arranged centrally within a slotted nozzle connected to a vacuum source such that on opposite sides of the compressed air conduit slot portions are formed.

The particles to be removed from the printing substrate (paper surface) are, in general, non-stick agents that prevent adhesion between stacked or adjacent paper layers.

A cleaning device disclosed in German patent 20 06 716 for removing by vacuum dust from the endless printing substrates supplied to the printing machine is based on the principle that a combined compressed air and suction air system optimizes the cleaning effect. Based on the assumption that the drawings of this German patent application are representative for the size of the cleaning device, the suction box having individual suctions slots and the compressed air conduit (blower box) arranged within has a total width which corresponds to approximately 14 to 19 times the opening width of the compressed air outlets while the compressed air conduit (blower box) has a total width which is approximately 10 to 14 times the width of the compressed air outlets. The printing substrate to be cleaned is thus subjected, due to the great width of the suction box, to an increased electrostatic charge. This carries the risk that, due to the suction slots spaced at a relatively great distance to the compressed air outlets, the dust particles initially removed from the printing support by the compressed air will again settle on the printing substrate. This tendency can be counteracted only to a minimal extent by providing multiple rows of compressed air outlets.

SUMMARY OF THE INVENTION

It is therefore an object of the present invention to eliminate the disadvantages of the aforementioned device. This is accomplished by providing the air outlets with a diameter of 2 mm to 4 mm, preferably 2.5 mm to 3 mm, and by the slotted nozzle, including the width of the compressed air conduit, having a total width of 15 mm to 25 mm.

The decisive feature of the present invention is thus that the suction slots are arranged in direct vicinity of the compressed air outlets in order to ensure that dust particles which have been already removed by the compressed air from the printing substrate will not settle on the printing substrate and forth is purpose, the total width of the slotted nozzle including the compressed air conduit is only approximately 6 times the diameter of the compressed air outlets.

By providing the inventive cleaning device with a dust removal device comprised of a container containing the cleaning liquid and a jet for creating turbulence within the cleaning liquid a further object of the invention, protection of the environment, is solved.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 4.

Figure 1:
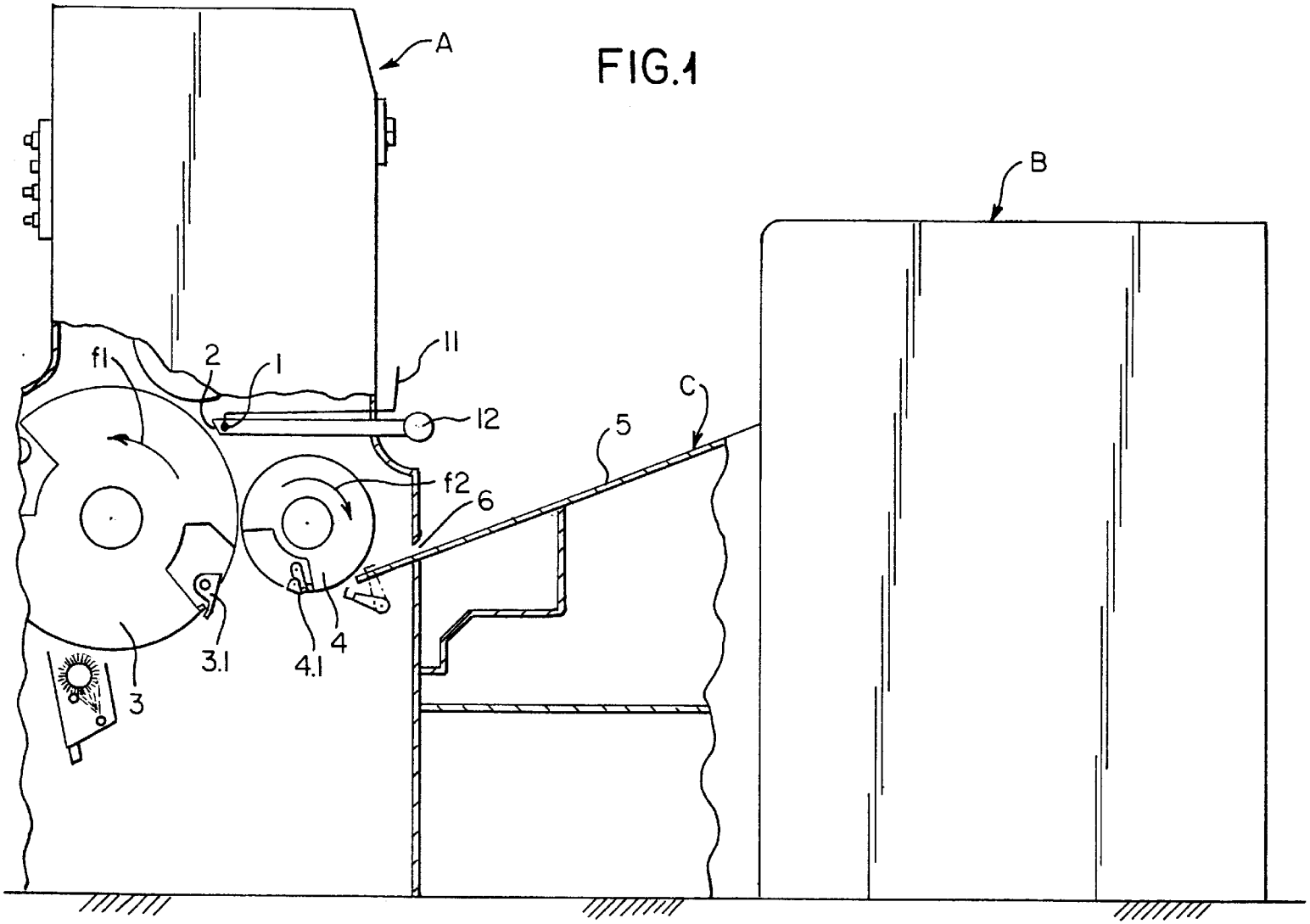
FIG. 1 shows a schematic representation of a portion of a printing machine with a cleaning device arranged at the printing cylinder.

FIG. 1 shows in a schematic representation a printing machine A with printing cylinder 3 and transfer roller 4 for transferring the sheets (printing substrates) which are respectively furnished with sheet gripping devices 3.1, respectively, 4.1. The printing cylinder 3 rotates in the direction of arrow f1 and the transfer roller 4 rotates in the direction of arrow f2. The housing B contains the printing substrates, for example, in the form of stacked paper sheets. The individual sheets are transported from the housing B in a conventional manner, unrelated to the invention, to a transfer station C which has a transfer table 5, whereby the printing substrates are fed to the transfer roller 4 via insertion slots 6 and are then individually transferred onto the printing cylinder 3.

Inventively, the printing cylinder 3, respectively, its mantle surface has coordinated therewith a cleaning device which is schematically represented in FIG. 1 and comprises a slotted nozzle 2 with integrated compressed air conduit 1, whereby the slotted nozzle 2 is connected to a vacuum source.

Figure 2:
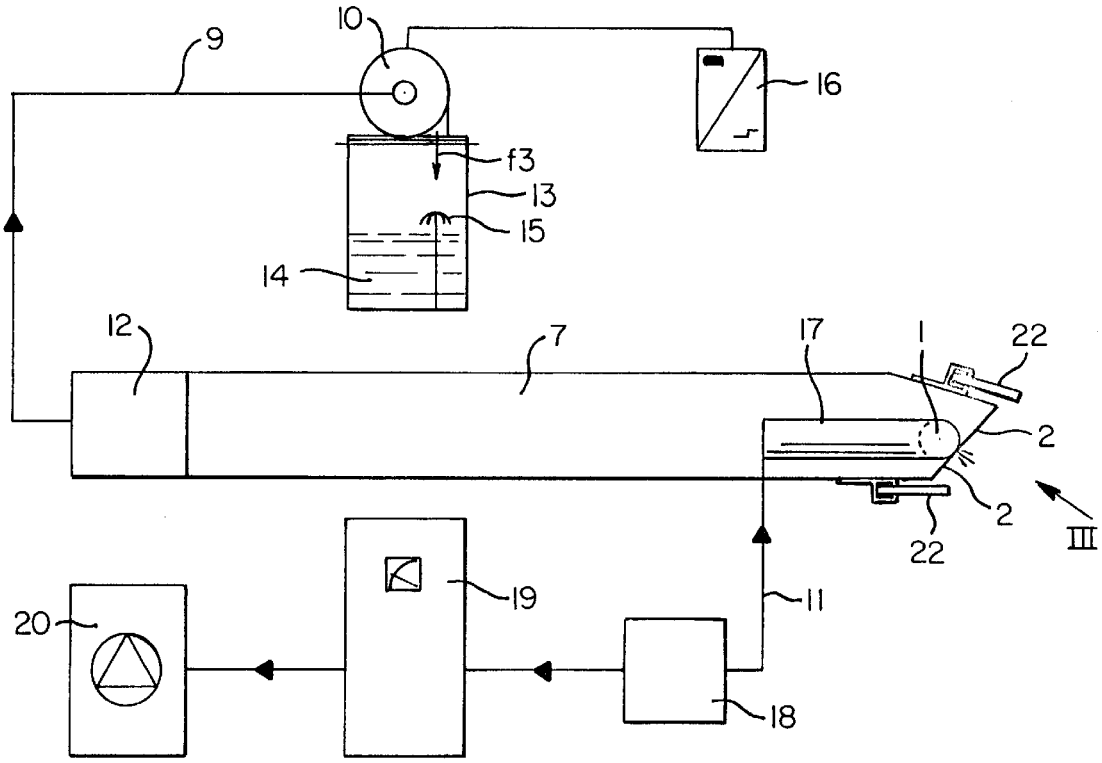
FIG. 2 shows in an enlarged representation the inventively designed cleaning device.

According to FIG. 2 the inventive compressed air/vacuum system comprises a vacuum chamber 7 connected by a vacuum connector 12 and a suction line 9 to a suction fan 10 having a pressure socket for blowing the contaminated air in the direction of arrow f3 into the dust removal device 13 in which cleaning water 14 is contained that is subjected to the action of a jet generating turbulence. The cleaned air is then guided away from the device by a non-represented connector. It is possible to connect to the suction fan 10 to a frequency converter 16.

At the forward end of the vacuum chamber 7 the inventive slotted nozzle 2 is arranged in which, extending in parallel, the compressed air conduit 1 is inserted having air outlets 1.1 positioned in the area of the outer slot opening. The compressed air conduit 1 is substantially arranged centrally within the slot opening such that on both sides of the compressed air conduit 1 partial slots 2—2 are formed. At the forward end of the slotted nozzle 2—2 spacers 22 are arranged.

The compressed air conduit 1 is connected via the compressed air connector 17 to a compressed air line 11. The compressed air system comprises a pressure governor 18 with pressure vessel 19 upstream thereof that has connected thereto a compressor 20.

Figure 3:
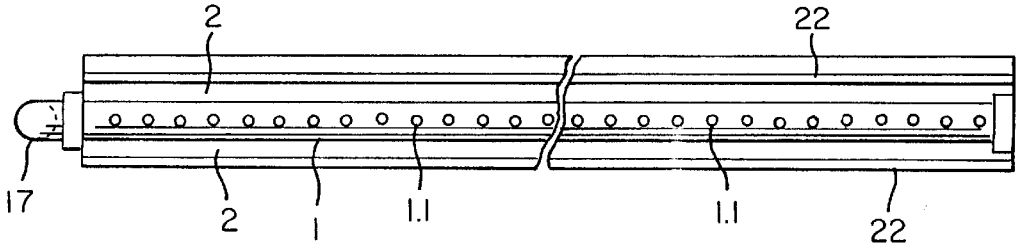
FIG. 3 shows in a front view the slotted nozzle with integrated compressed air conduit.

According to FIG. 3 the compressed air conduit 1 extends over the entire length of the slotted nozzle 2—2. The compressed air outlets 1.1 have a diameter of 2 to 4 mm, preferably approximately 2.5 mm to 3 mm, and are spaced at a distance of 7 mm to 15 mm relative to one another, preferably at a distance of 8 mm to 10 mm. The slotted nozzle 2 has a total width in a range of 15 mm to 25 mm, whereby a portion of this width is taken up by the compressed air conduit 1.

During operation of the inventive device the compressed air conduit 1 blows compressed air onto the paper sheets so that a turbulent layer or a flicker effect results in order to remove the particles adhering to the paper surface therefrom which then are directly removed by vacuum into the slotted nozzle. The blowing pressure and the suction pressure can be adjusted continuously in order to exactly determine the ratio between compressed air and vacuum.

In the compressed air portion a pressure of approximately 400 kPa to 700 kPa is preferred.

The printing machine A can be supplied with continuous material instead of individual sheets which is then provided in the housing B, for example, in the form of a paper roll.

The specification incorporates by reference the disclosure of German priority document 197 32 235.2 of Jul. 26, 1997.

The present invention is, of course, in no way restricted to the specific disclosure of the specification and drawings, but also encompasses any modifications within the scope of the appended claims.

What is claimed is:

1. A printing machine comprising:

a printing cylinder receiving printing substrates for printing;

a cleaning device for removing dust particles from the printing substrates transferred to said printing cylinder;

said cleaning device comprising a slofted nozzle having a slot opening;

a vacuum source connected to said slotted nozzle;

said cleaning device further comprising a compressed air conduit extending perpendicular to a direction of movement of the printing substrates;

said compressed air conduit arranged centrally in said slot opening and extending in a longitudinal direction of said slot opening such that on opposite sides of said compressed air conduit two slots are formed in said longitudinal direction;

said compressed air conduit having compressed air outlets directing an air flow onto the printing substrates, wherein unobstructed air flow is provided between said air outlets and said two slots such that a turbulent air layer results that removes the dust particles from a surface of the printing substrates and the dust particles are sucked into said slotted nozzle by the vacuum created by said vacuum source;

said compressed air outlets having a diameter of 24 mm; and said slotted nozzle having a width of 15 to 25 mm.

2. A printing machine according to claim 1, wherein said diameter is 2.5 to 3 mm.

3. A printing machine according to claim 1, wherein said compressed air outlets are spaced apart at a distance of 7–15 mm.

4. A printing machine according to claim 3, wherein said compressed air outlets are spaced apart at a distance of 8–10 mm.

5. A printing machine according to claim 1, wherein said compressed air conduit is pressurized at a pressure of 400–700 kPa.

6. A printing machine according to claim 1, wherein said cleaning device further comprises a dust removal device, wherein said vacuum source is a suction fan having a pressure side connected to said dust removal device, said dust removal device comprising a container containing a cleaning liquid and a jet for generating turbulence in the cleaning liquid, wherein said dust removal device has an outlet for removing the cleaned air.

* * * * *